United States Patent [19]

Moore et al.

[11] 4,397,720

[45] Aug. 9, 1983

[54] REMOVAL OF CHLORATE AND HYPOCHLORITE FROM ELECTROLYTE CELL BRINE

[75] Inventors: Sanders H. Moore; Maurice R. Smith, both of Cleveland, Tenn.

[73] Assignee: Olin Corporation, New Haven, Conn.

[21] Appl. No.: 426,336

[22] Filed: Sep. 29, 1982

[51] Int. Cl.[3] ..... C25B 1/34

[52] U.S. Cl. ..... 204/98; 204/128; 423/437; 423/462; 210/749; 210/757

[58] Field of Search ..... 204/98, 128; 423/437, 423/462; 210/749, 757

[56] References Cited

U.S. PATENT DOCUMENTS

| | | | |
|---|---|---|---|
| 3,039,865 | 6/1962 | Gilbert et al. | 75/81 |
| 3,213,006 | 10/1965 | Crain et al. | 204/99 |
| 3,536,597 | 10/1970 | Yamori et al. | 204/99 |
| 3,785,942 | 1/1974 | Carlson | 204/99 |
| 3,801,480 | 4/1974 | Krieg | 204/99 |
| 3,935,098 | 1/1976 | Oda et al. | 210/38 |
| 4,124,459 | 11/1978 | Blanch et al. | 204/99 |
| 4,151,077 | 4/1979 | Nogueira et al. | 210/21 |
| 4,160,730 | 7/1979 | Nguyen | 210/48 |
| 4,169,773 | 10/1979 | Lai et al. | 204/98 |
| 4,272,338 | 6/1981 | Lynch et al. | 204/98 |
| 4,303,624 | 12/1981 | Dotson et al. | 423/184 |

OTHER PUBLICATIONS

"Concentration of Heavy Metals by Complexation on Dithocarbamate Resins" by Joseph F. Dingman, Jr., Kenneth M. Gloss, Ellen A. Milano and Sidney Siggia in *Analytical Chemistry,* vol. 46, No. 6, pp. 774–777, May 1974.

"Selective Concentration and Determination of Trace Metals Using Poly(Dithiocarbamate) Chelating Ion--Exchange Resins" by Dennis S. Hackett and Sidney Siggia in Environmental Analysis, Edited by Galen W. Ewing, Academic Press, Inc., New York, N.Y., 1977, pp. 253–265.

"Chelex 100 Chelating Ion Exchange Resin for Analysis, Removal or Recovery of Trace Metals", Bio.Rad Laboratories, Chemical Division, Product Information Sheet 2020, pp. 1–5, Mar. 1981.

*Primary Examiner*—R. L. Andrews

*Attorney, Agent, or Firm*—Arthur E. Oaks; Donald F. Clements

[57] ABSTRACT

A process for removing chlorate ions from a recirculating anolyte brine as typically used in membrane chlor-alkali cells is disclosed. In this, a portion of the circulating brine after dechlorination and resaturation with additional alkali metal chloride is diverted and treated with an acidified aliphatic aldehyde to convert substantially all of the hypochlorite and chlorate to chlorine dioxide, chlorine gas and chloride ion. When performed in this manner, substantially lower quantities of acid are required as compared to prior art processes and the problems with the generation of excessive quantities of $ClO_2$ are minimized.

15 Claims, 1 Drawing Figure

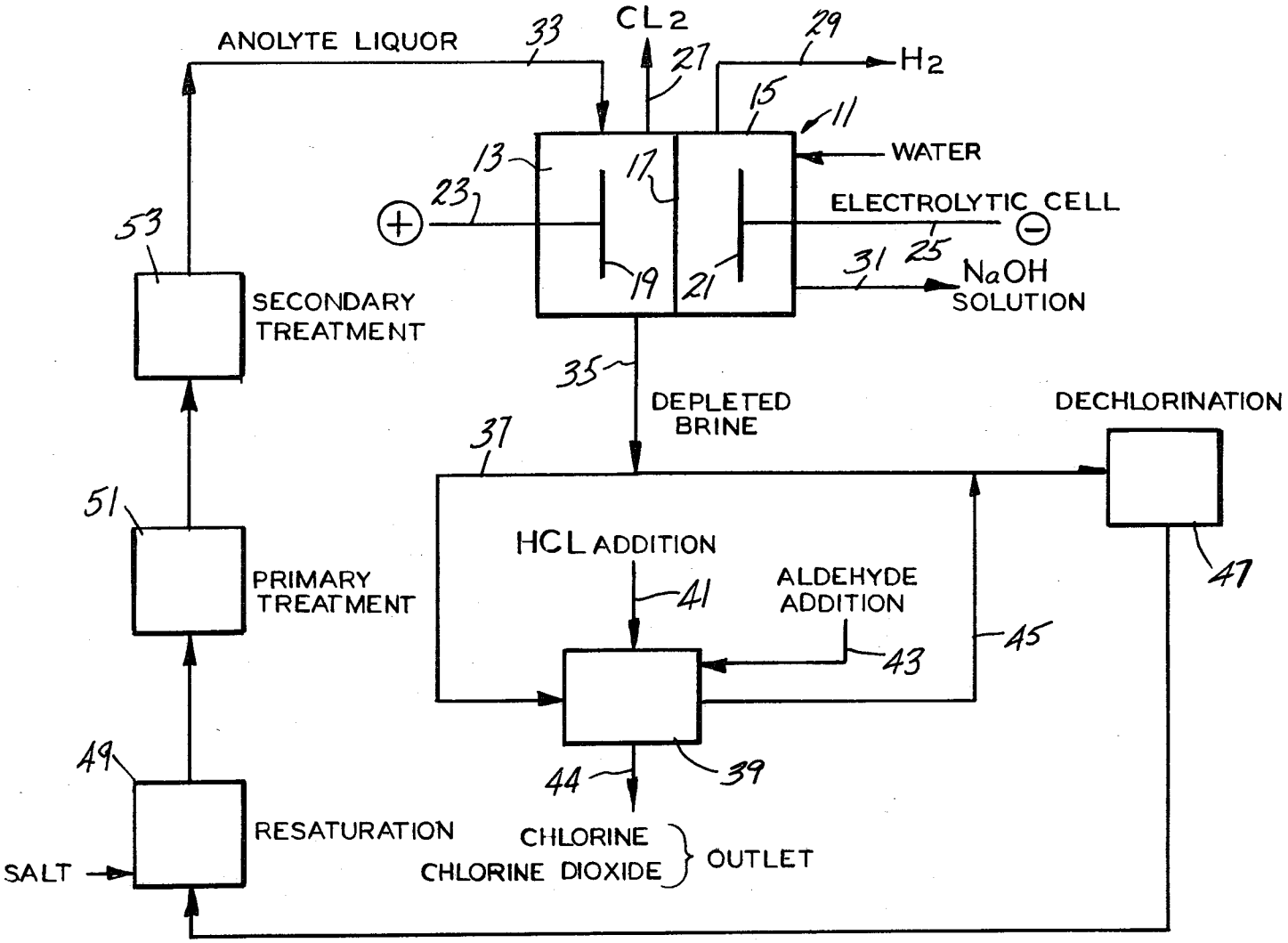
DECHLORINATION
47
45
ALDEHYDE ADDITION
43
39
OUTLET
CHLORINE
CHLORINE DIOXIDE
44
HCL ADDITION
41
DEPLETED BRINE
35
37
ELECTROLYTIC CELL
NaOH SOLUTION
25
31
WATER
11
H2
29
15
21
17
19
CL2
27
33
13
23
ANOLYTE LIQUOR
SECONDARY TREATMENT
53
PRIMARY TREATMENT
51
RESATURATION
49
SALT

REMOVAL OF CHLORATE AND HYPOCHLORITE FROM ELECTROLYTE CELL BRINE

BACKGROUND OF THE INVENTION

The present invention relates to a method for purifying an alkali metal halide brine used in the electrolytic production of high purity alkali metal hydroxide solutions and more particularly to a improved process for removing chlorate ions therefrom. The alkali metal chloride brines used in the present invention are produced as a depleted anolyte brine in alkali metal halide utilizing electrolytic cells by the passage of an electric current through said alkali metal halide brine. Elecrolytic cells are commonly employed commercially for the conversion of alkali metal halide into alkali metal hydroxide and halogen, fall into one of three general types—diaphragm, mercury and membrane cells.

Diaphragm cells utilize one or more diaphragms permeable to the flow of electrolyte solution but impervious to the flow of gas bubbles. The diaphragm separates the cell into two or more compartments. Following imposition of a decomposing current, halogen gases, given off at the anode, and hydrogen gas along with an alkali metal hydroxide are formed in the cathode. Although the diaphragm cell achieves relatively high production per unit floor space, at low energy requirement and at generally high current efficiency, the alkali metal hydroxide product, or cell liquor, from the catholyte compartment is both dilute and impure. The product may typically contain about 12% by weight of alkali metal hydroxide along with about 12% by weight of the original, unreacted alkali metal chloride. In order to obtain a commercial or salable product, the cell liquor must be concentrated and purified. Generally, this is accomplished by evaporation. Typically, the product from the evaporator is about 50% by weight alkali metal hydroxide containing about 1% by weight alkali metal chloride.

Mercury cells typically utilize a moving or flowing bed of mercury as the cathode and produce an alkali metal amalgam from the mercury cathode. Halogen gas is produced at the anode. The amalgam is withdrawn from the cell and treated with water to produce a concentrated high purity alkali metal hydroxide solution and hydrogen gas. Although mercury cell installations have many disadvantages including a high initial capital investment, undesirable ratio of floor space per unit of product and negative ecological considerations, the purity of the alkali metal hydroxide product is an inducement to its continued use. Typically, the alkali metal hydroxide product contains less than about 0.05% by weight of contaminating foreign ions.

Membrane cells utilize one or more membranes or barriers to separate the catholyte and anolyte compartments in the cell. These membranes are permselective; that is, they are generally permeable to either anions or cations. Generally, the permselective membranes utilized are cationically permselective. In membrane cells employing a single membrane, the membrane may be porous or non-porous. The membrane cells employing two or more membranes, porous membranes are usually utilized closest to the anode and non-porous membranes are usually utilized closest to the cathode. The catholyte product of the membrane cell is a relatively high purity alkali metal hydroxide. Catholyte cell liquor from a membrane cell is purer and has a higher caustic concentration than the product of the diaphragm cell.

It has been the objective, but frequently not the result, for diaphragm and membrane cells to produce "rayon grade" alkali metal hydroxide, that is, a product have a contamination of less than about 0.5% of the original salt. Diaphragm cells have not been able to produce such a product directly, because anions of the original salt freely migrate into the catholyte compartment of the cell. Membranes cells do have the capability to produce such a high quality alkali metal hydroxide product. However, one problem encountered in the operation of such cells is the production of chlorate in the anolyte compartment which will not readily pass through a cation, permselective membrane. Accordingly, chlorates concentrate in the anolyte, and after some period of operation of a closed loop brine system, may reach objectionable concentrations. While chlorates are not known to cause rapid deterioration of anode structures, high concentrations thereof do tend to cause deterioration of membrane performance, reduce the solubility of the salt thereby resulting in decreased efficiencies with possible salt precipitation and potentially adverse chlorate concentrations in the caustic product.

In the past, removal of chlorate from diaphragm cell liquor has been handled in a number of ways. For example, Johnson, in U.S. Pat. No. 2,790,707, teaches removal of chlorates and chlorides from diaphragm cell liquor by formation of iron salts by adding ferrous sulfate. Osborne, in U.S. Pat. No. 2,823,177, teaches the prevention of chlorate formation during electrolysis of alkali metal chloride in diaphragm cells by destruction of hypochlorite through distribution of catalytic amounts of nickel or cobalt in the diaphragm. It is noteworthy that considerable effort has been expended in chlorate removal from catholyte cell liquor, a highly alkaline medium. In such a solution, chlorate ion is quite stable and therefore tends to persist in the cell effluent and to pass on through to the evaporators in which the caustic alkalis are concentrated. Practically, all of the chlorate survives this evaporation and remains in the final product where it constitutes a highly objectionable contaminant, especially to the rayon industry.

The problem of lowering chlorates in diaphragm cells has been attacked at two main points:

(a) the chlorates having been formed, can be reduced in the further processing of the caustic alkali and by special treatments; or (b) production of chlorates during electrolysis can be lowered by adding a reagent to the brine feed which reacts preferentially with the back migrating hydroxyl ions from the cathode compartment of the cell making their way through the diaphragm into the anolyte compartment, and by such a reaction, prevents the formation of some of the hypochlorites and thus additionally preventing these hypochlorites from further reacting to form chlorates. Reagents such as hydrochloric acid or sulfur in an oxidizable form, such as sodium tetrasulfide, have been used to attack this problem.

In membrane cell operation, it is conventional to recycle spent brine from the anolyte compartment for resaturation. Satisfactory operation can be achieved so long as the chlorate concentration in the anolyte brine stream is kept below about 1.0% (i.e., about 10 g/l). In modern cells, the chlorate concentration buildup during the normal residence time of the anolyte brine solution therein is about 0.05% to about 0.1% per pass. Thus, if the initial chlorate content in the anolyte brine is acceptable, it is not necessary to remove all the chlorate present, only the additional chlorate formed in the cell during this residence time, to keep the brine within usable limits. In the past, removal of chlorate sufficient to keep the brine satisfactory has been accomplished by purging a portion of the depleted brine and adding fresh brine as makeup. In many facilities, the purged chlorate containing brine is often used as feedstock in a separate chlorate cell.

More recently, brines recovered from electrolytic cells which recirculate the brine have been treated for hypochlorite and chlorate reduction or elimination by the addition of a mineral acid such as hydrochloric acid. The treated brine is then blown with air or $CO_2$ or placed under a vacuum to remove $Cl_2$ present. Where hydrochloric acid, in particular, is employed, excessive amounts are often required to effectively reduce the chlorate ion concentration.

Recently, Lai et al. in U.S. Pat. No. 4,169,773 have shown that the amount of acid required to lower the chlorate concentration in a circulating brine stream can be significantly reduced by reacting a portion of said stream prior to dechlorination. In this procedure, substantially all the chlorate therein is destroyed, so that when the treated portion is added back to the main stream, the average chlorate value is within acceptable limits. However, the system used by Lai et al. calls for a separate dechlorination subsystem fo the treated portion.

In still another approach, sulfurous acid, as described in British Pat. No. 506,394, issued to I. G. Farbenindustries, or other sulfur-containing compounds such as alkali metal hydrosulfates (U.S. Pat. No. 3,891,747, issued June 24, 1975, to G. A. Galecki et al.) are used. However, these act to introduce sulfur-oxygen groups which are oxidized to sulfate. Sulfate ions are undesirable in brines fed to membrane cells and their concentration must be carefully controlled. Such a necessity adds considerably to the overall cost of the procedure.

U.S. Pat. No. 4,272,338, issued June 9, 1981, to R. L. Dotson et al., teaches the use of an inorganic peroxide such as $H_2O_2$ to remove dissolved chlorine and hypohalite ions such as hypochlorite or hypobromite ions. However, inorganic peroxides are not particularly effective in eliminating or reducing the chlorate ions present. In addition, the process teaches the use of a reducing agent such as an alkali metal thiosulfate to ensure complete reaction of hypochlorite ions present.

U.S. Pat. No. 4,303,624, issued Dec. 1, 1981, to R. L. Dotson et al., teaches the treatment of alkali metal chloride brines containing calcium ion impurities by the addition of an alkali metal carboxylate such as sodium oxalate at a pH below about 4.5 whereby reductions of chlorate present in brine are accomplished.

Now a process has been discovered which effectively reduces both the hypochlorite and chlorate ion concentrations in alkali metal chloride brines recovered from electrolytic cells while employing reduced amounts of mineral acids and eliminating the need for the addition of sulfur-containing reducing agents.

SUMMARY OF THE INVENTION

The present invention relates to a method for direct treatment of recirculating anolyte alkali metal halide liquor from chlor-alkali cell to effectively reduce the hypochlorite and chlorate contents therein. Although the process of the present invention may be utilized in the electrolysis of any alkali metal halide, sodium chloride is preferred and is normally the alkali metal halide used. However, other alkali metal chlorides, such as potassium chloride or lithium chloride, may be utilized. Similarly, while the discussion is in terms of membrane cell anolyte liquors, it should be understood that the method described herein also can be applied to anolyte liquors from mercury and diaphragm chlor-alkali cells.

The present invention comprises mixing either all or a portion of the chlorinated or dechlorinated, circulating anolyte brine of a membrane cell with a sufficient amount of mineral acid and aliphatic aldehyde so as to substantially remove chlorate values therefrom. When this is done, the chlorate content of said treated brine is converted to chlorine dioxide, chlorine gas and chloride, which can be returned to the cell. By so doing, it is found that the problems of adjusting the brine pH are substantially reduced. Thus, the treatment provides significant cost and operating advantages as compared to previously known methods for chlorate removal.

Therefore, it is the principal object of the present invention to provide an improved method for reducing the chlorate content of recirculating anolyte liquor.

It is a further object of the invention to provide a method for chlorate removal in a recirculating chlor-alkali cell anolyte liquor which requires less acid and operates at a higher overall throughput rate as compared to previously known chlorate removal methods.

These and other objects of the invention will become apparent from the following description and the appended claims.

BRIEF DESCRIPTION OF THE DRAWING

FIG. 1 is a flow diagram for the process of the present invention.

DETAILED DESCRIPTION OF THE INVENTION

The present invention will be described in more detail by the discussion of the accompanying drawing.

Membrane cell 11 is illustrated with two compartments, compartment 13 being the anolyte compartment and compartment 15 being the catholyte compartment. It would be understood that although, as illustrated in the drawing, and in the preferred embodiment, the membrane cell is a two compartment cell, a buffer compartment or a plurality of other buffer compartments may be included. Anolyte compartment 13 is separated from catholyte compartment 15 by cationic permselective membrane 17.

Cell 11 is further equipped with anode 19 and cathode 21, suitably connected to a source of direct current through lines 23 and 25, respectively. Upon passage of a decomposing current through cell 11, chlorine is generated at the anode and removed from the cell in gaseous form through line 27 for subsequent recovery. Hydrogen is generated at the cathode and is removed through line 29. Sodium hydroxide formed at the cathode is removed through line 31. Sodium hydroxide product taken from line 31 is substantially sodium chloride free, and generally containing less than 1% by weight of sodium chloride and has a concentration of NaOH in the range of from about 20% to about 40% by weight.

A feed of sodium chloride brine is fed into anolyte compartment 13 of cell 11 by line 33. The sodium chloride brine feed material entering cell 11 generally has from about 250 to about 350 grams per liter sodium chloride content. This solution may be neutral or basic, but is preferably acidified to a pH in the range of from about 1 to about 6, preferably achieved by pretreating it with a suitable acid such as hydrochloric acid. Such pretreatment along with techniques for adjusting the levels of $Ca^{++}$, $Mg^{++}$, $Fe^{++}$, $SO_4^{=}$ and other impurities are well known and widely used in the art.

Hot depleted sodium chloride brine is removed from anolyte compartment 13 at a temperature ranging from about 90 to about 105° C. The depleted brine typically contains about 20% sodium chloride and between about 1 and about 15% by weight of combined sodium hypochlorite and sodium chlorate. The pH of the depleted brine is generally about 6.

Either all or a portion of this depleted brine is treated in accordance with the process of this invention. Generally about 10 to about 30 and preferably from about 12 to about 25 percent by volume of the depleted brine removed from anolyte compartment 13 through anolyte recirculation line 35 is collected and conveyed through line 37 to reactor 39.

While chlorites and especially hypochlorites will be destroyed by treatment at a pH of 6, it is found that the pH must be adjusted to a range of between about 0 and about 2 and preferably between about 0.1 and about 1.0 before substantially all of the chlorate iron is effectively destroyed. Thus, the process of this invention calls for the addition of a mineral acid, preferably HCl, through inlet 41 to adjust the pH to this range. An aldehyde is added to reaction vessel 39 through inlet 43 for the removal of these ions. Outlet 44 is used for the removal of gaseous decomposition products, and outlet 45 is used to remove the treated brine. After treatment by the process of this invention, the treated brine is substantially free of hypochlorite and chlorate ions.

The treated portion from reactor 39 and liquid outlet 35 are then recombined and fed through dechlorinator 47, resaturator 49 and primary and secondary treatment vessels 51 and 53, respectively, for calcium and magnesium ion removal and pH adjustment. Techniques for these processes are well known in the industry and need not be described in detail.

It is not precisely known exactly what reactions are occurring within reactor 39. It is believed the nominal oxidation process between the hypochlorite and the aldehyde is as follows:

$$R-\overset{\overset{\displaystyle O}{\|}}{C}-H \xrightarrow{OCl^-} R\overset{\overset{\displaystyle O}{\|}}{C}-OH + Cl^- \qquad (1)$$

However, reaction of the hypochlorite with the lower aldehydes such as formaldehyde and glyoxal, the reaction further proceeds in acid media to:

$$H-\overset{\overset{\displaystyle O}{\|}}{C}-OH + OCl^- \longrightarrow CO_2 + H_2O + Cl^- \qquad (2)$$

Further, in highly acid media, the deomposition of $NaClO_3$ proceeds:

$$NaClO_3 + 6HCl \rightarrow NaCl + 3Cl_2 + 3H_2O \qquad (3)$$

It is postulated that the aldehyde is most effective against the hypochlorite content with the HCl largely acting to destroy the chlorate ions in the brine. Thus, it is found that hypochlorites are destroyed at essentially any acidic pH, while substantial destruction of the chlorates only occurs in very acid media.

The aldehyde used for these reactions can be any aliphatic mono- or dialdehyde having from about 1 to about 6 carbon atoms. However, formaldehyde $$(H-\overset{\overset{\displaystyle O}{\|}}{C}-H)$$

and, particularly, glyoxal $$(H-\overset{\overset{\displaystyle O}{\|}}{C}-\overset{\overset{\displaystyle O}{\|}}{C}-H)$$

are preferred since these, when oxidized, form only water and carbon dioxide as the reaction products. By so doing, no hydrocarbon acid contaminants are added to the recirculating brine stream.

The proportion of aldehyde is at least sufficient to provide a stoichiometric amount required to react with the hypohalite present, and is preferably in the range from about 2 to about 5 times the stoichiometric amount.

At the temperatures normally encountered in membrane cell operations, i.e., from about 90 to about 105° C., the chemical reaction between the chlorate ion and the acid/aldehyde medium proceeds quite rapidly especially when an excess of acid is applied. However, when dealing with continuous flow types of processes such as those encountered in membrane chlor-alkali cell operations, a certain period of "residence" is required in the reactor to allow sufficient time for the reaction to be completed. It has been found that in high velocity reactors wherein good mixing between the liquor and acid solutions can be easily achieved, "residence times" as short as about 20–30 minutes are adequate to substantially remove all chlorate ions present. In slower velocity systems, the time required is extended to between about 80 to about 110 minutes. However it is also found that as residence time increases, the amount of acid required to achieve a given level of chlorate ion removal decreases.

The exact values of brine velocity and residence time are not critical and will depend upon the operating and equipment parameters of the system. Whatever these values may be, it will be found that the amount of acid and aldehyde required to achieve a given level of chlorate removal will be substantially lower than that required in prior art methods. Thus, the method of this invention permits both substantial simplifications in system design and operating economies while still achieving necessary chlorate ion reduction.

Some $ClO_2$ will normally be created during these reactions which must be controllably reduced to $Cl_2+O_2$. Means to do this are well known in the art. The chlorine and oxygen products of the decomposition of chlorine dioxide may be either passed through a scrubber and absorbed in aqueous alkali for sodium hypochlorite production or may be joined to the cell system's chlorine handling system. The sodium chloride salt formed remains dissolved in the solution as it is recycled into the resaturator of the brine system. Any excess acid remaining in the chlorate depleted reaction liquor is utilized to adjust the pH of the cycling brine solution.

It will be recognized that possible additional elements, such as heat exchangers, steam lines, salt filters and washers, mixers, pumps, compressors, holding tanks, etc., have been left out of FIG. 1 for improved understanding but that the use of such auxiliary equipment and/or systems is conventional. Further, such systems such as the dechlorinator and the chlorine handling subsystems are not described in detail since such subsystems are well known in the chlor-alkali industry.

Membrane cells or electrolytic cells using permselective cation hydraulically semi-permeable or impermeable membranes to separate the anode and the cathode during electrolysis are also well known in the art. Within recent years, improved membranes have been introduced and such membranes are preferbly utilized in the present invention. These can be selected from several different groups of materials.

A first group of membranes includes amine substituted polymers such as diamine and polyamine substituted polymers of the type described in U.S. Pat. No. 4,030,988, issued on June 21, 1977 to Walther Gustav Grot and primary amine substituted polymers described in U.S. Pat. No. 4,085,071, issued on Apr. 18, 1978 to Paul Raphael Resnick et al. The basic precursor sulfonyl fluoride polymer of U.S. Pat. No. 4,036,714, issued on July 19, 1977 to Robert Spitzer, is generally utilized as the basis for those membranes.

A second group of materials suitable as membranes in the process of this invention includes perfluorosulfonic acid membrane laminates which are comprised of at least two unmodified homogeneous perfluorosulfonic acid films. Before lamination, both films are unmodified and are individually prepared in accordance with the basic '714 patent previously described.

A third group of materials suitable as membranes in the process of this invention includes homogeneous perfluorosulfonic acid membrane laminates. These are comprised of at least two unmodified perfluorosulfonic acid films of 1200 equivalent weight laminated together with an inert cloth supporting fabric.

A fourth group of membranes suitable for use as membranes in the process of this invention include carboxylic acid substituted polymers described in U.S. Pat. No. 4,065,366, issued to Oda et al. on Dec. 27, 1977.

The efficacy of the procedure for treating chlor-alkali cell brines is shown in the following examples. All parts and percentages are by weight unless specified otherwise.

EXAMPLE 1

A 2000 ml sample of membrane cell anolyte brine at a temperature of 90° C., a pH of 5.8, and a total of 4.27 g/l of NaOCl and $NaClO_3$ was treated with glyoxal in an amount equal to 3 moles glyoxal/mole of $OCl^-$ and $ClO_3^-$ with the following results:

| | Initial | 15 Minutes |
|---|---|---|
| g/l NaCl | 247.2 | 265.1 |
| g/l NaOCl | 0.55 | 0 |
| g/l $NaClO_3$ | 3.62 | 3.02 |
| pH | 5.8 | 1.8 |

This procedure was repeated but with sufficient HCl also being added to produce a pH of 0.2. Analysis of the treated brine was as follows:

| | Initial | 15 Minutes |
|---|---|---|
| g/l NaCl | 260.1 | 278.3 |
| g/l NaOCl | 0.63 | 0 |
| g/l $NaClO_3$ | 3.23 | 0.09 |
| pH | 0.2 | 0.1 |

EXAMPLE 2

Example 1 was repeated but with sufficient HCl being added to produce a pH of between 0.5 and 1.0.

| | Initial | 7.5 Min. | 10 Min. | 20 Min. |
|---|---|---|---|---|
| g/l NaCl | 219.1 | 214.1 | 220.7 | 223.4 |
| g/l NaOCl | 0.26 | 0.05 | 0 | 0 |
| g/l $NaClO_3$ | 1.99 | 0.54 | 0.48 | 0.17 |

The final pH was 0.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. In a process for purifying an alkali metal halide brine liquor used in the production of an alkali metal hydroxide and a halogen by the electrolysis in a cell having an anolyte and a catholyte compartment, said alkali metal halide brine liquor being circulated through said anolyte compartment wherein hypohalites and halates are produced within said brine liquor, said brine liquor then being recovered from said cell, dehalogenated, saturated with additional alkali metal halide and returned into said anolyte compartment, the improvement comprising:

(a) collecting at least a portion of said recycling liquor before said resaturation step;

(b) contacting said collected portion with at least a stoichiometric amount of an acid and an aldehyde for a residence time sufficient to reduce substantially all of the alkali metal hypohalite and halate within said portion to halogen and alkali metal halide; and (c) conveying said contacted portion to said resaturation step.

2. The process of claim 1 wherein between about 10 and about 30% of said recycling liquor is collected.

3. The process of claim 2 wherein between about 12 and about 25% of said recycling liquor is collected.

4. The process of claim 1 wherein said aldehyde is a monoaldehyde having from about 1 to about 6 carbon atoms.

5. The process of claim 4 wherein said monoaldehyde is formaldehyde.

6. The process of claim 1 wherein said aldehyde is a dialdehyde having up to about 6 carbon atoms.

7. The process of claim 6 wherein said dialdehyde is glyoxal.

8. The process of claim 1 wherein the portion of said aldehyde added to said portion is in the range of about 2 to about 5 times the stoichiometric amount needed to react with the hypohalite present.

9. The process of claim 1 wherein said acid is hydrochloric acid.

10. The process of claim 9 wherein said acid is added in an amount of about 6 to about 10 moles per mole of hypohalite and halate in said anolyte brine solution.

11. The process of claim 1 wherein said residence time is between about 20 and about 90 minutes.

12. The process of claim 1 wherein said collected portion is at a temperature between about 90 to about 105° C.

13. The process as set forth in claim 1 wherein the aqueous metal halide electrolyte is sodium chloride brine, the hypohalite is sodium hypochlorite, the halate is sodium chlorate and said halogen is chlorine.

14. A process for purifying a metal halide brine liquor for use in the electrolytic production of sodium hydroxide and chlorine which comprises electrolytically decomposing sodium chloride brine in an electrolytic cell comprising an anode chamber, a cathode chamber and a permselective cationic membrane separating said anode chamber from said cathode chamber; recovering said brine at the conclusion of said electrolysis as a chlorine containing anolyte liquor, further containing between about 1 and about 15% combined sodium hypochlorite and sodium chlorate dechlorinating and resaturating said liquor and returning said liquor to said membrane cell anode chamber; said process further comprising collecting from about 10 to about 30 percent of said liquor and contacting said collected portion with at least a stoichiometric amount of an aldehyde containing from about 1 to about 6 carbon atoms sufficient to react with the sodium hypochlorite present and sufficient hydrochloric acid to adjust the pH of said liquor to a range from about 0 to about 2.0 and to substantially decompose the sodium hypochlorite and sodium chlorate therein, recombining said collected portion with said liquor coming from said anode chamber to reduce the total chlorate content to an acceptable level prior to said liquor being recirculated back into said anode chamber.

15. The process of claim 14 wherein said aldehyde is glyoxal.

* * * * *